US005432690A

United States Patent [19]

Van der Vliet et al.

[11] Patent Number: 5,432,690

[45] Date of Patent: Jul. 11, 1995

[54] LUMINAIRE

[75] Inventors: Bart Van der Vliet; Ronald A. Plantinga, both of Eindhoven, Netherlands

[73] Assignee: U.S. Philips Corporation, New York, N.Y.

[21] Appl. No.: 167,275

[22] Filed: Dec. 14, 1993

[30] Foreign Application Priority Data

Dec. 21, 1992 [EP] European Pat. Off. ..... 92204042

[51] Int. Cl.[6] ..... F21S 3/00

[52] U.S. Cl. ..... 362/217; 362/260; 439/828; 439/239; 439/240

[58] Field of Search ..... 362/217, 260, 220; 439/240, 226, 828, 239

[56] References Cited

U.S. PATENT DOCUMENTS

| | | | |
|---|---|---|---|
| 1,208,217 | 12/1916 | Schade, Jr. | 439/828 |
| 1,339,111 | 5/1920 | Kaaten | 439/828 X |
| 1,976,312 | 10/1934 | Wachsman | 439/828 |
| 2,153,368 | 4/1939 | Reamer | 362/217 X |
| 2,198,841 | 4/1940 | Pittman et al. | 439/828 |
| 2,248,598 | 7/1941 | Yoder | 439/239 |
| 3,267,275 | 8/1966 | Kendal et al. | 362/217 |

*Primary Examiner*—Ira S. Lazarus
*Assistant Examiner*—Thomas M. Sember
*Attorney, Agent, or Firm*—Brian J. Wieghaus

[57] ABSTRACT

The luminaire has a base wall (1) bearing contact elements (2, 3). These elements are bent from metal sheet to have a base (20) and opposite arms (2, 3) extending therefrom each having a contact portion (23, 24) to contact a lamp terminal (43). The arms (2, 3) cross one another between the contact portions (23, 24) and the base (20). The construction allows for a low height and a free choice of sheet material.

12 Claims, 1 Drawing Sheet

LUMINAIRE

BACKGROUND OF THE INVENTION

The invention relates to a luminaire comprising:

a base wall with a first contact element and a second contact element electrically insulated from the first;

an electric lamp with a tubular lamp vessel having a first and a second end portion, in which lamp vessel an electric element is accommodated and connected to current conductors which issue from the lamp vessel to the exterior at respective end portions;

wherein each contact element is bent from metal strip material so as to have a base and a first and an opposing second arm extending away from the base and having a longitudinal direction, which arms have a first and a second contact portion, respectively, at a distance from the base and facing one another, thus keeping one of the current conductors of the lamp clamped in between them.

Such a luminaire is known from U.S. Pat. No. 3,267,275.

The contact elements of the known luminaire are substantially U-shaped. Their arms extend away from the base opposite to one another.

If a current conductor is to be gripped with clamping force, the arms must be closer together with their contact portions in the idle position, when there is no lamp, than in their operational position, when a lamp is present. To keep the lamp clamped in between them, the arms must first move apart comparatively far during taking-up of the lamp in order to allow the current conductor access to the contact portions, and then spring back into the operational position. It is important that the arms are not plastically deformed when the lamp is inserted, because this would mean the clamping force in the operational position is lost.

Plastic deformation can be prevented by giving contact elements comparatively long arms. Only a small elastic deformation need occur per unit length of the arms in order to allow the free-end portions to move apart comparatively far. A disadvantage of this is, however, that the constructional height of the contact elements, i.e. the distance from their free-end portions to the base, becomes comparatively great. Plastic deformation can also be prevented by the choice of a material which has a strong elastic deformability. Such material has the disadvantage, however, that the clamping force of the contact element formed therefrom is small.

SUMMARY OF THE INVENTION

It is an object of the invention to provide a luminaire of the kind described in the opening paragraph whose contact elements have a comparatively small constructional height and allow for a wide choice of material.

According to the invention, this object is achieved in that the first and the second arm cross one another between their contact portions and the base.

The shape of the contact elements with their crossed arms implies that the arms, given a certain constructional height, i.e. given a certain distance from their free ends to the base, have a greater length than in the known luminaire with the substantially U-shaped contact elements. As a result, a rigid material may be used to obtain a good clamping force, while nevertheless a sufficient elastic deformability is achieved owing to the length of the arms.

It is an attractive aspect of the contact elements that the electric lamp cannot be pressed to beyond the contact portions towards the base during insertion in the luminaire, which is the case in the known luminaire. The crossing arms prevent this. The crossing forms a stop for the current conductor.

In a favourable embodiment, the first arm has a free-end portion with a first and a second finger and the second arm extends between these fingers. Since the two arms cross, they grip the current conductor of the lamp next to one another. The couple which would result therefrom in the case of arms not provided with fingers could lead to rotation of the conductor. This is counteracted in the said embodiment.

In a modification of this embodiment, the second arm has a narrowed free-end portion with a lateral dimension transverse to the longitudinal direction of the arm which is substantially equal to the sum of lateral dimensions of the fingers, and a dimension in the longitudinal direction of the arm which is substantially equal to the dimension of the fingers in the longitudinal direction of the first arm. This modification has the advantage that the arms have a comparable stiffness. The position of the arms in their operational state is symmetrical relative to their position in the idle state as a result of this.

In a further implementation of these modifications, the fingers have the same lateral dimension. The fingers then exert equal forces on the current conductor and together exert the same force as the second arm. Forces which could lead to a rotation of the current conductor are then counteracted to an even higher degree.

BRIEF DESCRIPTION OF THE DRAWINGS

An embodiment of the luminaire according to the invention is shown in the drawing, in which.

DESCRIPTION OF THE PREFERRED EMBODIMENTS

Figure 1:
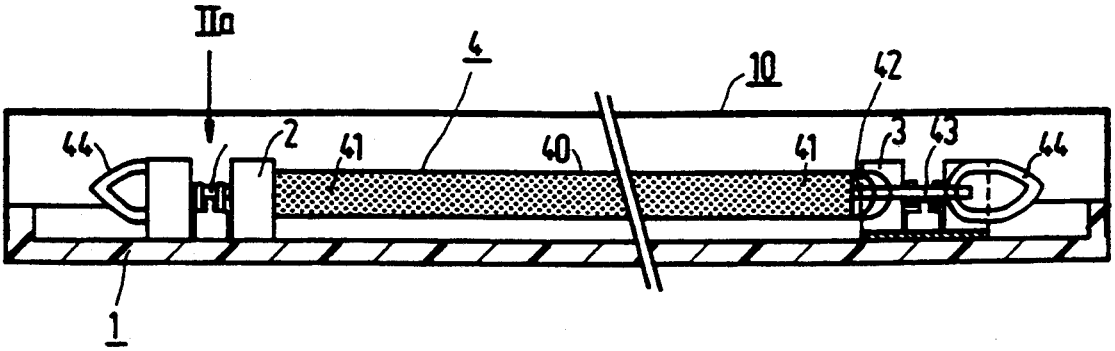
FIG. 1 is a longitudinal section of a luminaire with diagrammatically indicated contact elements, one of them in longitudinal section.

The luminaire of FIG. 1 has a base wall 1 with a first 2 and a second contact element 3 arranged so as to be electrically insulated from the first. In the embodiment drawn, the base wall is made of synthetic resin, but the wall may alternatively be made of a conductive material from which at least one of the contact elements is electrically insulated. The luminaire according to the embodiment drawn has a light-transmitting cover 10 with side walls. The side walls may either be connected to the base wall, or integral therewith. Alternatively again, the luminaire may be open or may be closed off, for example, by a louvre. The luminaire may be provided with a reflector, with electronics for starting and/or operating the lamp, and may accommodate wiring for supplying the lamp.

An electric lamp 4 with a tubular lamp vessel 40 having a first and a second end portion 41 is present in the luminaire. The lamp shown is a linear low-pressure mercury discharge lamp with a coating of fluorescent powder on the lamp vessel wall. The lamp could alternatively be angled, curved, or, for example, meandering or bent into a three-dimensional shape. The lamp may alternatively contain, instead of mercury and rare gas, only a rare gas, for example, neon, or a mixture of rare gases. An electric element 42, connected to current conductors 43 issuing from the lamp vessel 4 to the exterior at respective end portions 41, is present in the lamp vessel. The electric element in the lamp shown is a pair of electrodes. Each electrode is a hollow metal tube integral with the relevant current conductor. The lamp vessel shown is closed off at either end portion with a respective glass tube 44 which is fused to the current conductor 43 and which is sealed at its free end. The electric element may alternatively be an incandescent body, for example, in a gas comprising halogen.

The luminaire may be used, for example, for, e.g. decorative, lighting purposes or for giving signals.

The contact elements 2, 3 of the luminaire are bent from metal strip material so as to have a base 20 and a first 21 and an opposing second arm 22 extending away from the base and having a longitudinal direction. The arms have a first 23 and a second contact portion 24, respectively, at a distance from the base 20 and facing one another, with which they keep one of the current conductors 43 of the lamp 4 clamped in between them.

Figure 2A:
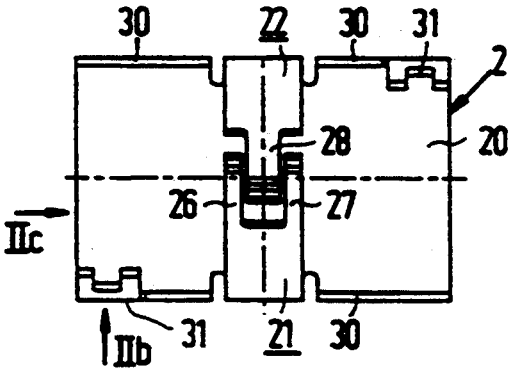
FIG. 2*a* shows a contact element of FIG. 1 taken on the line IIa.
Figure 2C:
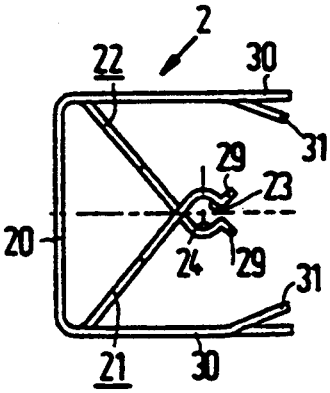
FIG. 2*c* shows a modification of the element of FIG. 2*b* taken on the line IIc.

The first 21 and the second arm 22 cross one another between their contact portions 23, 24 and the base 20 (see FIG. 2*c*). It is evident from FIGS. 1 and 2 that the contact elements in the embodiment shown are not or hardly larger, especially higher, than is necessary for accommodating the lamp.

Figure 2B:
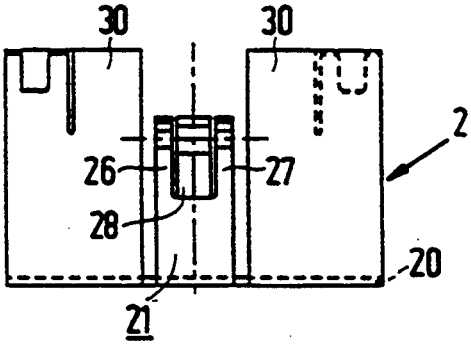
FIG. 2*b* shows the element of FIG. 2*a* taken on the line IIb.

The first arm 21 has a free-end portion with a first 26 and a second finger 27, while the second arm 22 projects between these fingers 26, 27 (FIGS. 2*a*, 2*b*).

The second arm 22 has a narrowed free-end portion 28 with a lateral dimension transverse to the longitudinal direction of the arm 22 which is substantially equal to the sum of lateral dimensions of the fingers 26, 27. The dimension of the narrowed end portion in the longitudinal direction of the arm 22 is substantially equal to the dimension of the fingers 26, 27 in the longitudinal direction of the first arm 21.

The fingers 26, 27 have the same lateral dimension.

The contact element of FIG. 2*c* is different from the contact elements of the other Figure in that a portion 29 bent outwards is present at the arms so as to guide the current conductor of the lamp towards the contact portions.

It is evident from this Figure that a lamp cannot be pressed towards the base to beyond the contact portions owing to the crossed arrangement of the arms. The distance from the contact portions to the base in the Figure is no more than $1/\sqrt{2}$ of the distance in a substantially U-shaped contact element having arms of the same length.

The contact element shown is made of hardened spring steel and is nickel-plated for obtaining corrosion resistance and for improving the soldering characteristics. The contact element has fins 30 which contribute to the removal of heat transferred by the current conductor. The contact element has soldering tags 31 for connecting the elements to a supply source.

We claim:

1. A luminaire, comprising:

a base wall with a first contact element and a second contact element electrically insulated from the first;

an electric lamp which is energizeable for emitting light, said lamp having a tubular lamp vessel having a first and a second end portion and current conductors which issue from the lamp vessel to the exterior at respective end portions;

wherein each contact element is comprised of metal strip material formed so as to have a base and a first and an opposing second arm extending away from the base and having a longitudinal direction, which arms have a first and a second opposing contact portion, respectively, at a distance from the base and facing one another, for clamping one of the current conductors of the lamp therebetween, the first and the second arms crossing one another between their contact portions and the base and having free ends spaced from one another so that a current conductor is insertable between said contact portions when moved only linearly towards said base wall in a direction transverse to said lamp and transverse to said base of said contact, and wherein said first and second arms of each contact element include a stop for preventing deflection of said first and second contact elements past a predetermined distance from said base wall, whereby said current conductor cannot be pressed towards said base wall beyond said stop.

2. A luminaire as claimed in claim 1, characterized in that the first arm (21) has a free-end portion with a first and a second finger, and the second arm extends between these fingers.

3. A luminaire as claimed in claim 2, characterized in that the second arm has a narrowed free-end portion with a lateral dimension transverse to the longitudinal direction of the arm which is substantially equal to the sum of the lateral dimensions of the fingers, and a dimension in the longitudinal direction of the arm which is substantially equal to the dimension of the fingers in the longitudinal direction of the first arm.

4. A luminaire as claimed in claim 3, characterized in that the fingers have the same lateral dimension.

5. A contact for a luminaire, comprising:

a length of metal strip material including a base and first and second opposing arms extending away from the base, which arms have first and second opposing contact portions, respectively, at a distance from the base and facing one another, for clamping a pin-shaped current conductor of a lamp therebetween, the first and the second arms crossing one another between their contact portions and the base, the first and second contact portions having free ends spaced from one another so that a pin-shaped current conductor is insertable between said contact portions when moved only linearly towards said base in a direction transverse to said current conductors and transverse to said base, and wherein said first and second arms include a stop for preventing deflection of said first and second arms past a predetermined distance from said base wall, whereby said current conductor cannot be pressed towards said base wall beyond said stop.

6. A contact according to claim 5, characterized in that the first arm has a free-end portion with a first and a second finger, and the second arm extends between these fingers.

7. A contact according to claim 6, characterized in that the second arm has a narrowed free-end portion with a lateral dimension transverse to the longitudinal direction of the arm which is substantially equal to the sum of the lateral dimensions of the fingers, and a dimension in the longitudinal direction of the arm which is substantially equal to the dimension of the fingers in the longitudinal direction of the first arm.

8. A contact according to claim 7, characterized in that the fingers have the same lateral dimension.

9. A lamp fixture for receiving a tubular lamp defining a lamp axis and having opposing end portions with a respective current conductor extending from each end portion parallel to said lamp axis, said fixture comprising:

a base wall with a first contact element and a second contact element electrically insulated from and spaced from the first contact element for receiving the lamp current conductors, each contact element being comprised of a metal strip material and including a base and first and second opposing arms extending away from the base, said arms having a first and second opposing contact portion, respectively, at a distance from the base and facing one another, for clamping one of the current conductors of the lamp therebetween, the first and the second arms crossing one another between their contact portions and the base, the first and second contact portions having free ends spaced from one another so that a current conductor is insertable between said contact portions when moved only linearly towards said base wall in a direction transverse to said lamp axis and transverse to said base of said contact element, and wherein said first and second arms of each contact element include a stop for preventing deflection of said first and second contact elements past a predetermined distance from said base wall, whereby said current conductor cannot be pressed towards said base wall beyond said stop.

10. A lamp fixture according to claim 9, characterized in that the first arm has a free-end portion with a first and a second finger, and the second arm extends between these fingers.

11. A lamp fixture according to claim 10, characterized in that the second arm has a narrowed free-end portion with a lateral dimension transverse to the longitudinal direction of the arm which is substantially equal to the sum of lateral dimensions of the fingers, and a dimension in the longitudinal direction of the arm which is substantially equal to the dimension of the fingers in the longitudinal direction of the first arm.

12. A lamp fixture according to claim 11, characterized in that the fingers have the same lateral dimension.

* * * * *